US005769566A

United States Patent [19]

Shea

[11] Patent Number: 5,769,566

[45] Date of Patent: Jun. 23, 1998

[54] CATCH BASIN SPLASH GUARD

[76] Inventor: Gerald Shea, 3 Gibson Rd., Natick, Mass. 01760

[21] Appl. No.: 613,607

[22] Filed: Mar. 11, 1996

[51] Int. Cl.[6] ..... E03F 5/14

[52] U.S. Cl. ..... 405/52; 210/166

[58] Field of Search ..... 405/52; 210/164, 210/166

[56] References Cited

U.S. PATENT DOCUMENTS

| | | | |
|---|---|---|---|
| 660,731 | 10/1900 | McLam | 210/164 |
| 1,310,055 | 7/1919 | Caldwell | 210/164 |
| 2,101,978 | 12/1937 | Boosey | 182/31 |
| 2,993,600 | 7/1961 | Ressler | 210/164 |
| 3,556,993 | 1/1971 | Persson | 210/164 |
| 4,136,010 | 1/1979 | Pille et al. | 210/164 |
| 4,419,232 | 12/1983 | Arntyr et al. | 210/164 |
| 5,004,534 | 4/1991 | Buzzelli | 210/164 |
| 5,015,371 | 5/1991 | Webb | 210/164 |
| 5,032,264 | 7/1991 | Geiger | 210/163 |
| 5,345,741 | 9/1994 | Slater et al. | 52/646 |
| 5,372,714 | 12/1994 | Logue, Jr. | 210/164 |
| 5,383,745 | 1/1995 | Shannon | 405/52 |
| 5,443,327 | 8/1995 | Akkala et al. | 405/118 |

*Primary Examiner*—Tamara L. Graysay
*Assistant Examiner*—Tara L. Mayo
*Attorney, Agent, or Firm*—Brian M. Dingman

[57] ABSTRACT

A catch basin splash guard for inhibiting water impacting the catch basin side walls, comprising an upper rim section defining an opening of about the same shape as that of the catch basin frame, the rim section adapted to rest on the frame lip; and depending side walls projecting down from the rim section at essentially 90°, to define an outlet of about the same size as the opening so as not to obstruct water flow through and out of the splash guard; wherein the side walls direct water flowing into the catch basin away from the catch basin walls and down toward the catch basin bottom, to inhibit wall corrosion and erosion caused by incoming water.

11 Claims, 5 Drawing Sheets

CATCH BASIN SPLASH GUARD

FIELD OF INVENTION

This invention relates to a splash guard insertable into catch basins to prevent incoming water from impacting and corroding the catch basin side walls.

BACKGROUND OF INVENTION

Virtually every paved surface is designed to direct water into catch basins built under the surfaces. The catch basins collect rain water, melting ice and snow, and other water and typically direct it into a conduit leading from the catch basin. There are millions of catch basins in the United States.

As water enters the catch basin, some of it impacts or splashes against the upper side walls. Through erosion and corrosion caused primarily by road salt dissolved in the water, the impacting water tends to slowly destroy the brick or concrete block from which the catch basin side walls are made. When this happens, the catch basin usually partially collapses. To repair such a catch basin may take one or more man days and heavy equipment such as backhoes. Millions of dollars, or more, of man and machine time, and materials, are spent annually to repair eroded and corroded catch basins.

SUMMARY OF THE INVENTION

It is therefore an object of this invention to provide a splash guard to prevent water from impacting the catch basin side walls.

It is a further object of this invention to provide such a splash guard that does not obstruct the flow of water into the catch basin.

It is a further object of this invention to provide such a splash guard that is easy to insert and remove from the catch basin.

It is a further object of this invention to provide such a splash guard which is inexpensive to manufacture and install.

This invention features a catch basin splash guard for inhibiting water impacting the side walls of the catch basin in which it is installed. The splash guard includes an upper rim section which defines an opening of about the same shape, and about the same size, of that of the catch basin frame opening. The rim section is adapted to rest on the frame lip. There are depending side walls projecting down from the rim section at essentially 90° to define an outlet of about the same size as the opening so as not to obstruct water flow through and out of the splash guard. These side walls direct water flowing into the catch basin away from the catch basin walls and down toward the catch basin bottom to inhibit wall corrosion and erosion caused by incoming water.

The splash guard rim section is preferably at least about 1" wide. The splash guard is preferably unitary, and is preferably made from plastic or sheet metal. The opening is typically rectangular or "D" shaped, depending on the catch basin frame shape. The side walls may be flexible or fairly rigid. In one embodiment, the side walls are flexible, for example made of a mesh material such as a fine netting-type material. In this case, the side walls can be made connectable to the rim section by including connectors spaced about the rim section for securing the side walls to the rim section.

BRIEF DESCRIPTION OF THE DRAWINGS

Other objects, features and advantages will occur to those skilled in the art from the following description of preferred embodiments, and the accompanying drawings, in which.

DESCRIPTION OF THE PREFERRED EMBODIMENTS

This invention may be accomplished in a catch basin splash guard for inhibiting water impacting the catch basin side walls. There is an upper rim section which defines an opening of about the same shape and size as that of the catch basin frame, in which the rim section is adapted to rest on the frame lip. There are depending side walls projecting down from the rim section when the catch basin splash guard is installed in a catch basin. The walls project down at essentially 90° to hang essentially straight down, so that the splash guard outlet is essentially the same size as the inlet. This effectively does not inhibit the flow of water into the catch basin, which after all is the primary objective of a catch basin. These side walls direct water flowing into the catch basin away from the catch basin walls and down toward the catch basin bottom to inhibit wall corrosion and erosion caused by incoming water which otherwise would impact against the side walls.

Figure 1B:
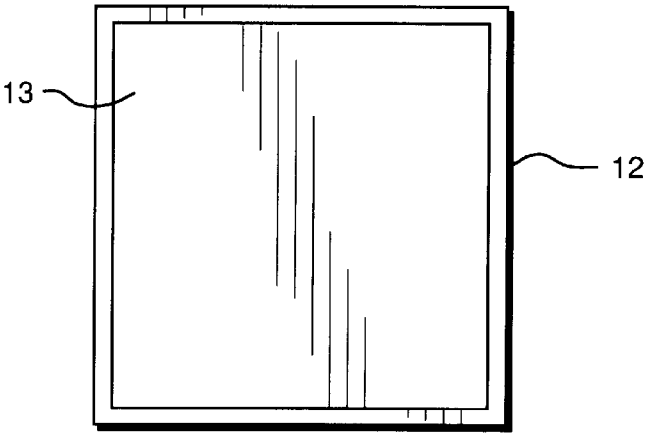
FIG. 1B is a top view of the splash guard of FIG. 1A.
Figure 1A:
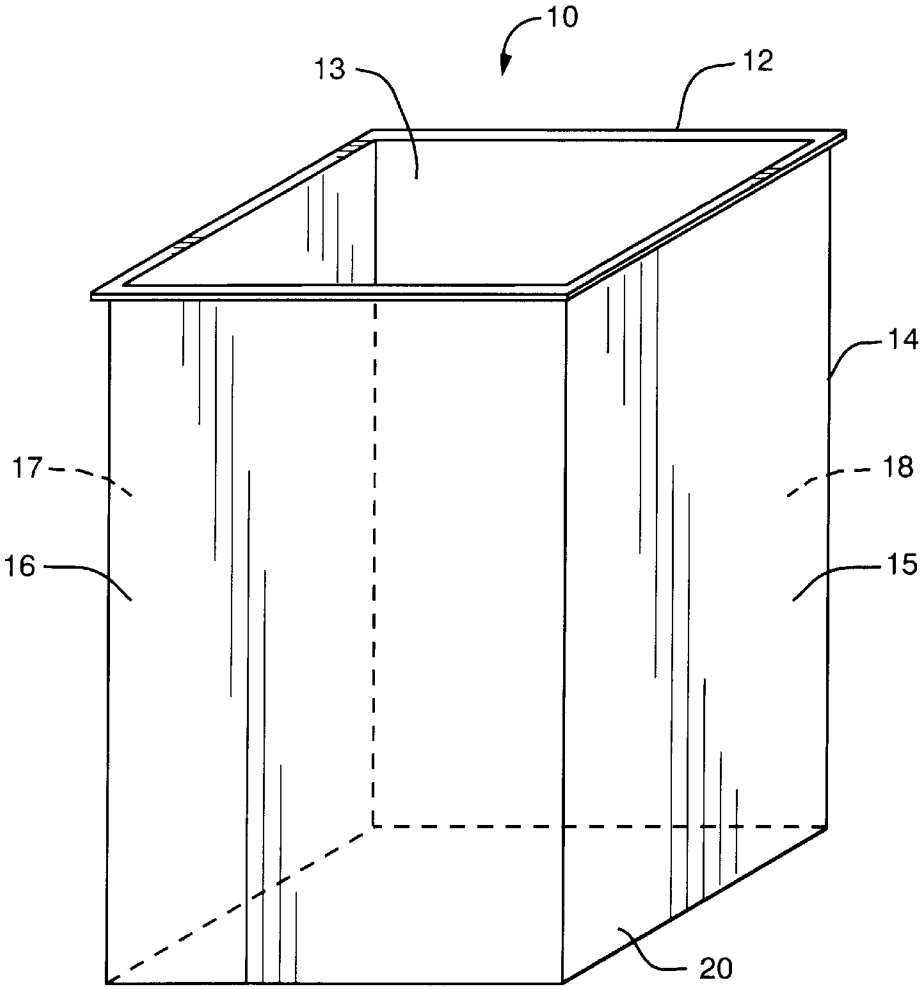
FIG. 1A is a perspective view of one form of the catch basin splash guard according to this invention.
Figure 2A:
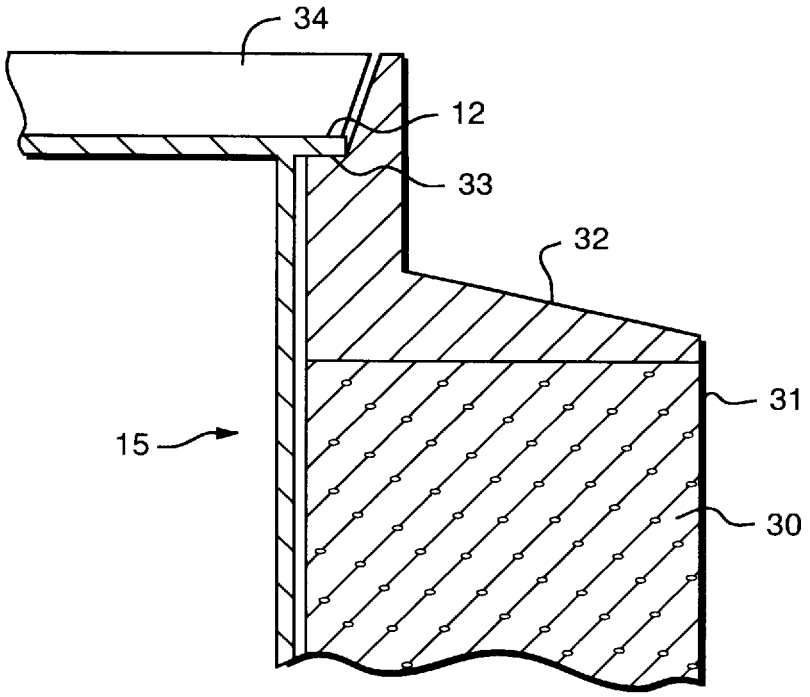
FIG. 2A is a partial, cross sectional view of the splash guard of FIGS. 1A and lB installed in a typical catch basin.
Figure 2B:
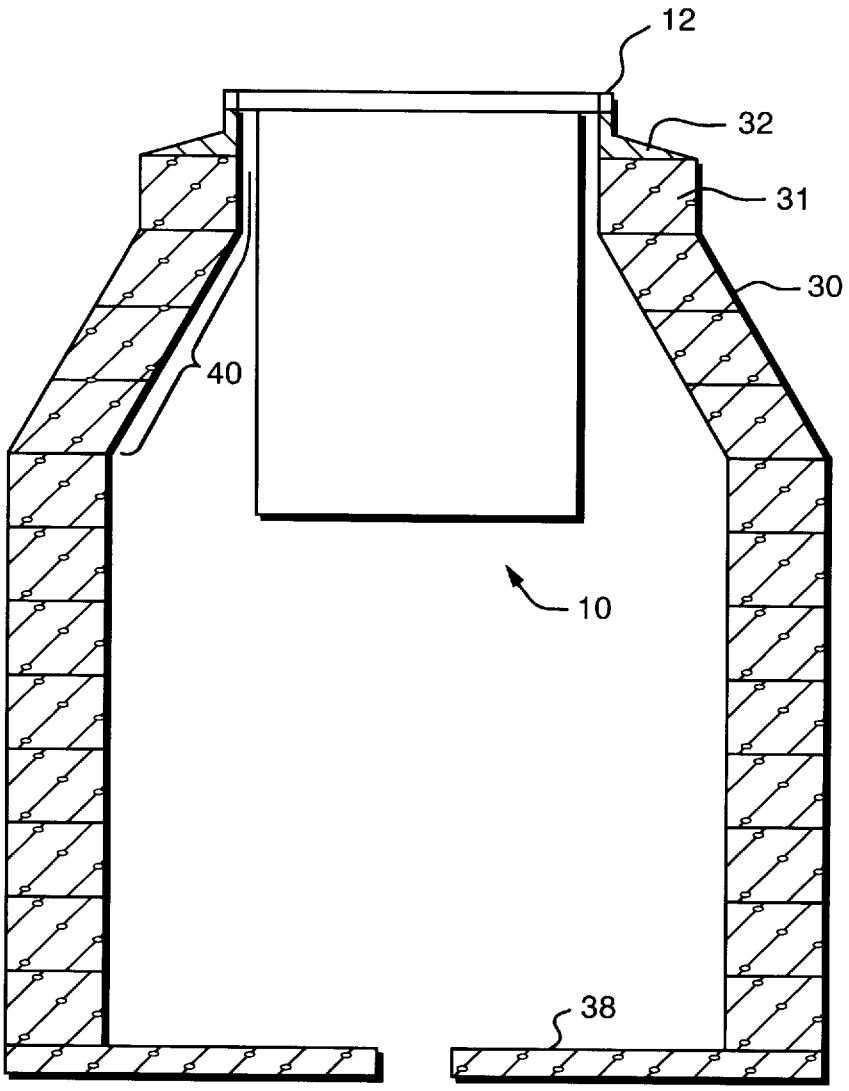
FIG. 2B is a schematic representation of the catch basin and splash guard of FIG. 2A.

One embodiment of catch basin splash guard 10 according to this invention is shown in FIGS. 1 and 2. Splash guard 10 includes upper rim section 12 defining opening 13 of about the same size and shape as that of the catch basin frame opening in which it is placed. As best shown in the top view of FIG. 1B, rim section 12 in this embodiment is an approximately 1" wide (or wider as needed) rectangular frame defining a rectangular opening 13. As shown in FIGS. 2A and 2B, rim 12 is adapted to rest on the lip or shoulder 33 of catch basin 30 frame 32 that sits on the top of wall 31 of catch basin 30. Shoulder 33 is designed to hold cover grate 34.

Splash guard 10 also includes depending side walls 15 through 18 which project down from rim section 12 at essentially 90° to define outlet 20 of about the same size as opening 13 so as not to obstruct water flow through and out of splash guard 10. These side walls typically project down a distance of approximately 30Δ.

Water enters the catch basin through cover grate 34. Rim 12 sits between cover 34 and lip 33. Splash guard 10 thus is easily inserted in the catch basin at any time that cover grate 34 is removed therefrom, for example during periodic clean-outs of the catch basin. Once splash guard 10 is in place, water entering through the openings in grate 34 cannot impact or splash against upper wall section 40 of basin 30. The water will impact against splash guard wall section 14, run down the walls, and drop into bottom 38 of catch basin 30.

Splash guard 10 is preferably of unitary construction. It may be made of plastic, either molded or sheet plastic that is scored and folded to create the rim and side wall corners, or multiple pieces welded together. The splash guard can also be made of other sheet materials such as aluminum or other materials that will not corrode when exposed to the weather.

Figure 3:
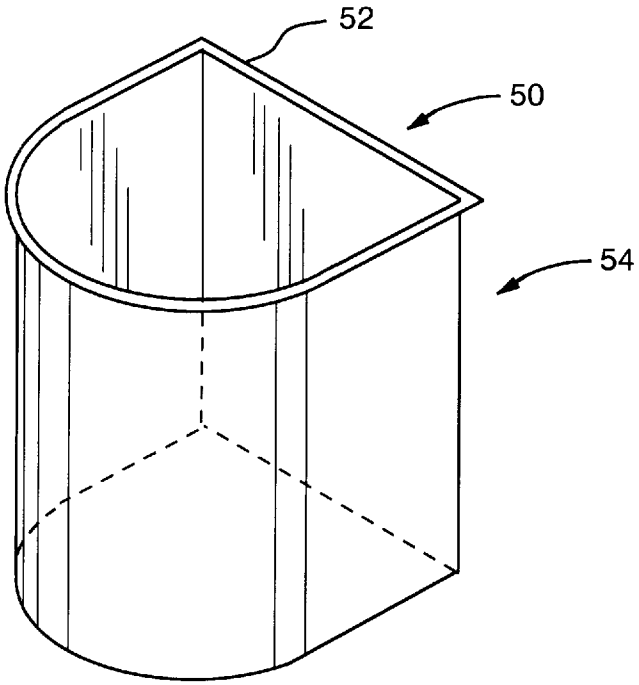
FIG. 3 is a perspective view of another shape of a splash guard according to this invention.

The shape of the splash guard of this invention is determined by the shape of the catch basin frame on which the splash guard is placed. Common shapes are the rectangular shape shown in FIGS. 1 and 2, and the "D" shape shown in FIG. 3, in which splash guard 50 has upper rim 52 and depending side walls 54.

Figure 5:
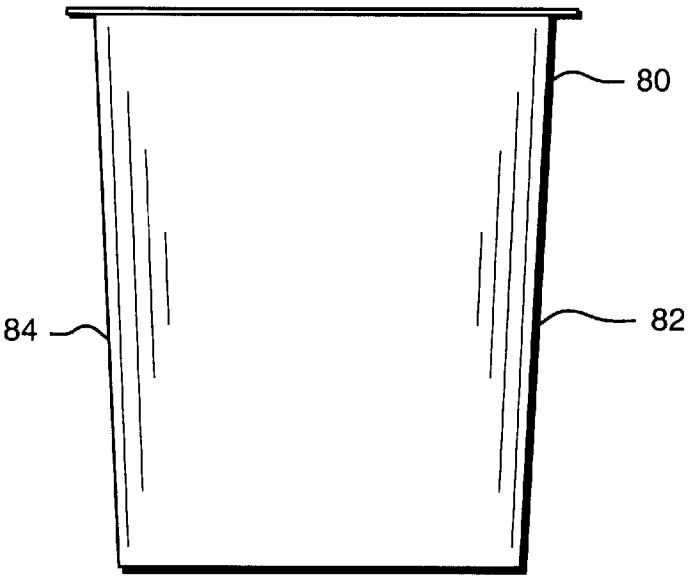
FIG. 5 is a cross sectional schematic view of another embodiment of a splash guard according to this invention.

The side walls need not project straight down. As schematically shown in FIG. 5, sidewalls 82 and 84 of splash guard 80 have a slight inward taper of up to approximately 10° so that the splash guards can be stacked one in another in storage to decrease the amount of space that the splash guards take up in storage. Such a slight taper creates a slightly smaller outlet opening which does not substantially inhibit water flow.

Figure 4B:
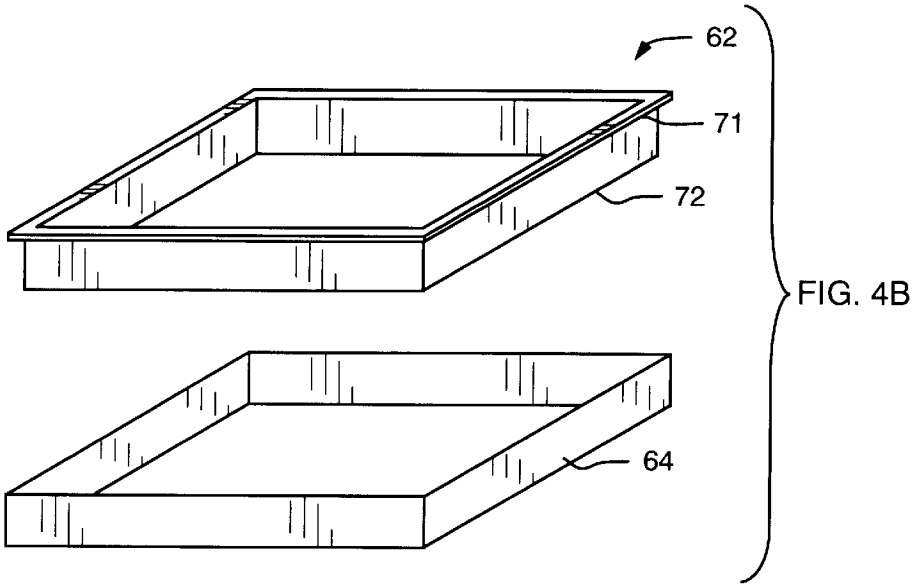
FIG. 4B is a partial, exploded, view of the upper rim section of the splash guard of FIG. 4A.
Figure 4A:
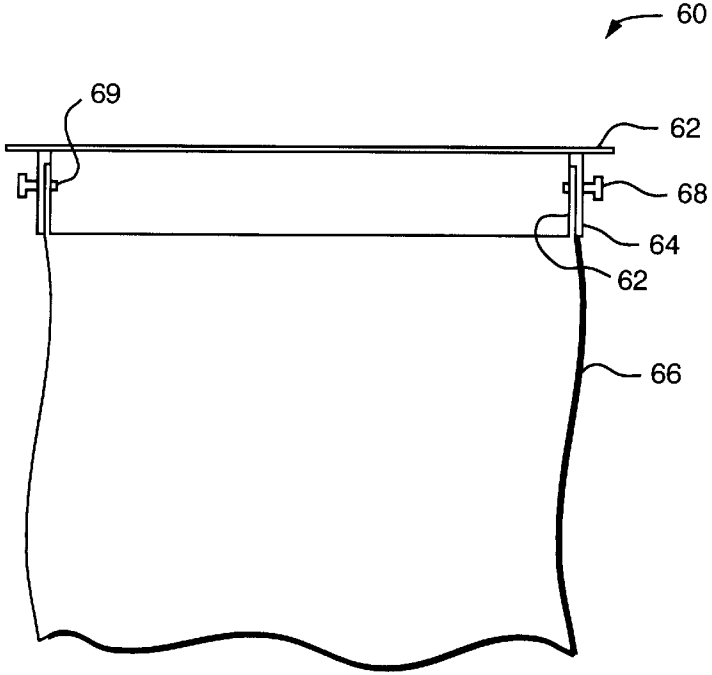
FIG. 4A is a schematic, cross sectional view of another embodiment of a splash guard according to this invention.

An alternative manner of accomplishing the splash guard of this invention is with side walls that are flexible, for example of a cloth or mesh or thin plastic material. One manner of accomplishing such side walls is shown in FIGS. 4A and 4B, in which splash guard 60 has an upper rim section formed of inner ring 62 and outer ring 64. Held between these two rings is side wall member 66 made of flexible material. This embodiment is assembled by placing the upper end of side wall member 66 up against inner circumferential portion 72 of inner ring 62 with rim section 71. Outer ring 64 is then placed over section 72, and fasteners such as bolts or screws 68 and 69 are passed through sections 64 and 72, and through the intermediate side wall 66. Preformed holes with reinforcing such as grommets may be included in portion 66 to prolong its life. This construction creates the same effect as the other embodiments.

Other constructions are contemplated herein. For example, a flexible side wall member such as member 66 could be simply hung from studs projecting from portion 72, doing away with outer ring 64. There are myriad other possibilities for fixing side walls or a side wall member to an upper rim section that is adapted to rest on a catch basin frame lip. These are contemplated within the scope of the present invention.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A splash guard for a catch basin having a bottle neck with a lip which is open to a surface and which funnels water incoming from said surface into an enlarged subterranean cavity having basin walls and a basin floor, comprising:

an upper rim section defining an opening of about the same shape as that of said lip, said rim section adapted to rest on said lip; and depending side walls projecting down from said rim section at essentially 90 degrees into said subterranean cavity, to define an outlet of about the same size as the opening so as not to obstruct water flow through and out of said splash guard;

wherein said side walls direct water incoming from said surface away from said basin walls and down toward said basin floor, to inhibit basin wall corrosion and erosion caused by said water incoming from said surface.

2. The splash guard of claim 1 in which said rim section is at least about 1" wide.

3. The splash guard of claim 1 in which said splash guard is unitary.

4. The splash guard of claim 3 in which said splash guard is made from plastic.

5. The splash guard of claim 3, in which said splash guard is made from sheet metal.

6. The splash guard of claim 1 in which said opening is rectangular.

7. The splash guard of claim 1 in which said opening is "D" shaped.

8. The splash guard of claim 1 further including connectors spaced about said rim section for securing said sidewalls to said rim section.

9. The splash guard of claim 1 in which said side walls are flexible.

10. The splash guard of claim 9 in which said side walls are of mesh material.

11. A splash guard for a catch basin having a bottle neck with a lip which is open to a surface and which funnels water incoming from said surface into an enlarged subterranean cavity having basin walls and a basin floor, comprising:

a plastic upper rim section defining an opening of about the same shape as that of said lip, said rim section adapted to rest on said lip; and depending plastic side walls projecting down from said rim section at a slight inward taper into said subterranean cavity, to define an outlet slightly smaller than the opening so as not to obstruct said water incoming from said surface through and out of said splash guard into said subterranean cavity;

wherein said side walls direct said water incoming from said surface away from said basin walls and down toward said basin floor, to inhibit wall corrosion and erosion caused by incoming water.

* * * * *